US005701711A

United States Patent [19]

Bases et al.

[11] Patent Number: 5,701,711

[45] Date of Patent: Dec. 30, 1997

[54] HANGER ASSEMBLY FOR LAGGING PANEL

[75] Inventors: Gary John Bases, Copley; Roger A. Detzel, Norton; Douglas James Devault, Rootstown, all of Ohio; William Joseph Ferkile, St. Petersburg, Fla.

[73] Assignee: The Babcock & Wilcox Company, New Orleans, La.

[21] Appl. No.: 681,188

[22] Filed: Jul. 22, 1996

[51] Int. Cl.[6] ..... E04B 2/30; E04B 1/74

[52] U.S. Cl. ..... 52/506.03; 52/404.1; 52/506.05; 52/506.06

[58] Field of Search ..... 52/506.02, 506.06, 52/508, 404.1, 506.01, 506.03, 506.04, 506.05, 698

[56] References Cited

U.S. PATENT DOCUMENTS

| | | | |
|---|---|---|---|
| 4,081,938 | 4/1978 | Bertacchi et al. | 52/506.06 X |
| 4,287,839 | 9/1981 | Severin et al. | 52/506.02 X |
| 4,391,075 | 7/1983 | Musgrave | 52/404.1 |
| 4,549,382 | 10/1985 | Byrd, Jr. | 52/506.02 |
| 4,584,814 | 4/1986 | Hounsel et al. | 52/506.02 X |
| 4,653,171 | 3/1987 | Coble | 52/506.02 X |
| 4,791,769 | 12/1988 | Miller | 52/506.02 X |
| 4,932,187 | 6/1990 | Kraemer et al. | 52/506.02 X |

FOREIGN PATENT DOCUMENTS 641288 12/1963 Belgium .

*Primary Examiner*—Michael Safavi

*Attorney, Agent, or Firm*—Robert J. Edwards; D. Neil LaHaye

[57] ABSTRACT

A means of attaching and supporting lagging that integrates attachment and support for both insulation and lagging. Angle irons are welded to the hot surface. Insulation pins are also welded to the hot surface at two different levels in a pattern that will support the insulation. The insulation is impaled on the insulation pins. A first subgirt is placed on the angle irons and welded at one end only to an angle iron. The insulation pins are received and extend through bores in the first subgirt. A second subgirt is received on insulation pins at a different level. A fastener is installed oil the end of each insulation pin to hold the subgirts against the outer surface of the insulation. The end of each pin is bent to retain the fasteners in place. The lagging panels are bolted to the subgirts.

1 Claim, 1 Drawing Sheet

HANGER ASSEMBLY FOR LAGGING PANEL

BACKGROUND OF THE INVENTION

1. Field of the Invention

The invention is generally related to anchors for supporting material on walls and more particularly to the support of lagging for boilers or furnaces and their components.

2. General Background

Lagging is a metal sheet used to cover insulation on all hot surfaces of boilers and their components. In the current state of the art, attachment and support of the lagging is accomplished by using three-eighth inch diameter knurled studs welded to the hot surface. A square drive plate is then driven onto the knurled stud. A metal subgirt is then screwed to the drive plates and the lagging is then screwed to the subgirt. Although this method of lagging attachment is structurally sound, it is not as economical as desired. It has also been typical that the lagging and insulation have been supported by separate support systems.

SUMMARY OF THE INVENTION

The invention addresses the above need. What is provided is a means of attaching and supporting lagging that integrates attachment and support for both insulation and lagging. Angle irons are welded to the hot surface. A first set of insulation pins is welded to the hot surface at approximately the same level as the angle irons in a pattern that will support the insulation. Other sets of insulation pins are welded to the hot surface at different levels than the first set of pins. The insulation is impaled on the insulation pins. A first subgirt is placed on the angle irons and welded at one end only to an angle iron. The insulation pins are received and extend through bores in the first subgirt. A second, lower subgirt having bores therethrough is received on a second set of pins. A fastener is installed on the end of each insulation pin to hold the subgirts against the outer surface of the insulation. The end of each pin is bent to retain the fasteners in place. The lagging panels are bolted to the subgirts.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
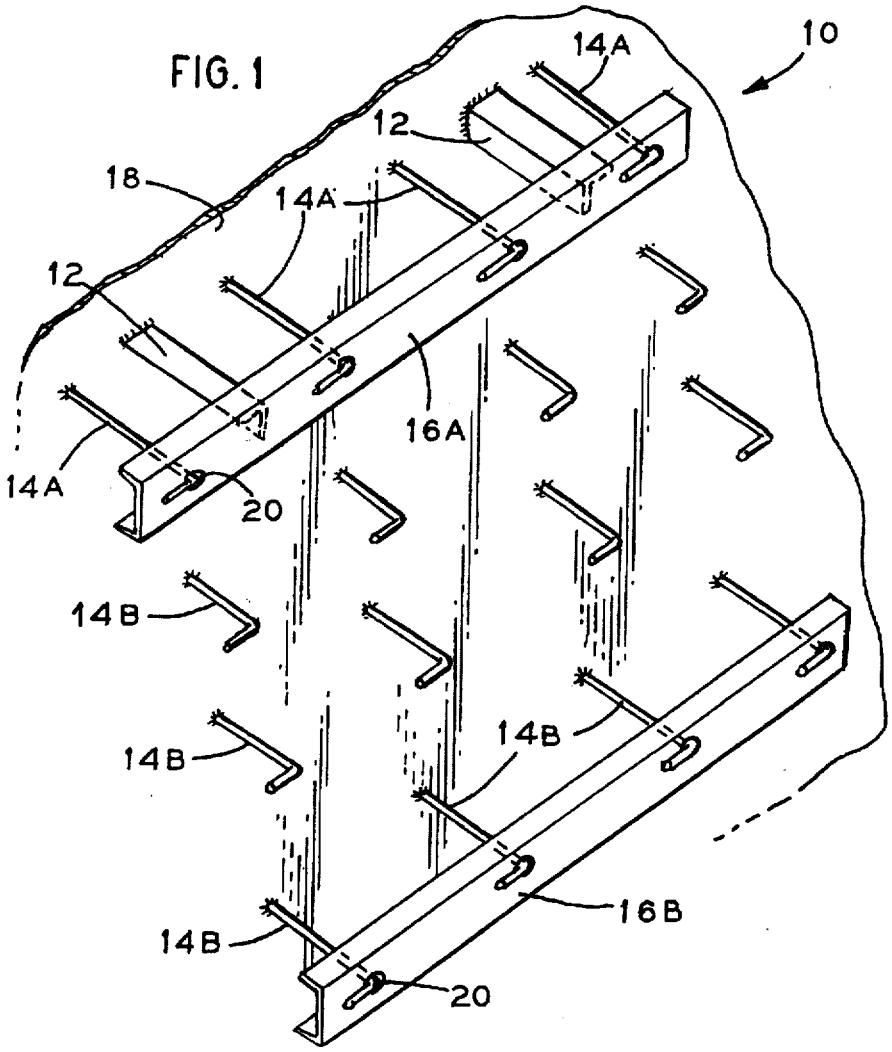
FIG. 1 is a perspective view of the assembly.

Referring to the drawings, it is seen in FIG. 1 that the invention is generally indicated by the numeral 10. Hanger assembly 10 is comprised of angle irons 12, pins 14, and subgirts 16.

Angle irons 12 each have one end rigidly attached to the hot surface 18 of a furnace or boiler component, perpendicular to the hot surface, such that the opposite end of the angle iron is spaced apart from the hot surface 18. The method of attachment may be by any means suitable for the working environment such as welding. In the preferred embodiment, angle irons 12 are attached to the hot surface at an elevation that is approximately three feet below the top of lagging panels once they are installed. Although only two angle irons 12 are shown, it should be understood that two or more angle irons 12 may be required.

Pins 14 also have one end rigidly attached perpendicualrly to the hot surface in the same manner as angle irons 12. Pins 14 are sized to have a length longer than angle irons 12, the purpose of which will be explained below. A first set of pins 14A are installed at approximately the same level as angle irons 12. Other sets of pins 14B are attached perpendicularly and spaced apart from the first pins at a lower elevation on the hot surface 18. The above reference to a lower elevation is for ease of reference and it should be understood that the invention may also be applied to surfaces that are not in a vertical orientation.

Subgirt 16A is illustrated as a U-shaped channel but may also be angle iron that is capable of resting upon angle irons 12. Subgirt 16B is also illustrated as a U-shaped channel but may be angle iron or flat bar. Both subgirts 16 are provided with bores 20 for receiving pins 14 therethrough. In the preferred embodiment, subgirt 16A is rigidly attached to only one angle iron 12, preferably at one end of subgirt 16A, by any suitable means such as welding. The remaining length of subgirt 16A rests on angle irons 12. This allows sliding of the free end of the subgirt in conjunction with expansion and contraction of the hot surface 18.

Figure 2:
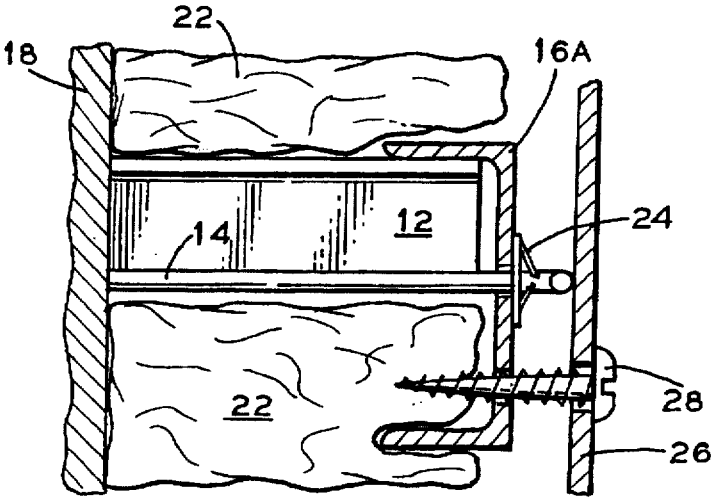
FIG. 2 is a side sectional view of the upper portion of the assembly with the insulation and lagging panel in place.

As seen in FIG. 2, insulation 22 is positioned against the hot surface 18 by being impaled on pins 14. First subgirt 16A is positioned upon angle irons 12 with pins 14 extending through the bores in subgirt 16A. A fastener 24 such as a speed nut is used to secure first subgirt 16A against the insulation 22 and angle iron 12. The end of each pin 14 is then bent to secure the fastener 24 in position. The second subgirt 16B is positioned against the insulation 22 such that a second set of pins 14B extend through the bores 20. Second subgirt 16B is secured in position on the pins by the use of fasteners and bending of the pins as described above. A lagging panel 26 is then fastened to the subgirts 16 by any suitable means such as a screw 28. With this assembly, the angle irons 12, subgirt 16A, and the pins 14 combine to provide a single assembly that provides the vertical support for both the insulation 22 and lagging panels 26. Subgirt 16B serves to retain the lagging panels 26 in position against the insulation 22. The number of second subgirts 16B used is dependent on wind and suction loading.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A hanger assembly for supporting a lagging panel from a hot surface, comprising:

a. a plurality of angle irons attached to the hot surface;

b. a first set of pins attached to the hot surface at approximately the same level as said angle irons;

c. a first subgirt received on said angle irons and rigidly attached to only one of said angle irons, said subgirt having a plurality of bores such that one end of said first set of pins extend through the bores in said subgirt;

d. a second set of pins attached to the hot surface and spaced apart from said first set of pins;

e. a second subgirt having a plurality of bores such that one end of said second set of pins extend through the bores in said second subgirt;

f. means for securing said subgirts on said pins; and g. means for attaching a lagging panel to said subgirts.

* * * * *